US008955524B2

(12) United States Patent
White

(10) Patent No.: US 8,955,524 B2
(45) Date of Patent: Feb. 17, 2015

(54) FILTER AND METHOD FOR MAKING A FILTER FOR A CIGARETTE

(75) Inventor: Peter Rex White, London (GB)

(73) Assignee: British American Tobacco (Investments) Limited, London (GB)

( * ) Notice: Subject to any disclaimer, the term of this patent is extended or adjusted under 35 U.S.C. 154(b) by 892 days.

(21) Appl. No.: 12/671,200

(22) PCT Filed: Jul. 25, 2008

(86) PCT No.: PCT/EP2008/059817

§ 371 (c)(1),
(2), (4) Date: Jun. 25, 2010

(87) PCT Pub. No.: WO2009/019154

PCT Pub. Date: Feb. 12, 2009

(65) Prior Publication Data

US 2010/0263682 A1 Oct. 21, 2010

(30) Foreign Application Priority Data

Aug. 3, 2007 (GB) ..... 0715172.3

(51) Int. Cl.
*A24D 3/04* (2006.01)

(52) U.S. Cl.
CPC ..... *A24D 3/043* (2013.01)
USPC ..... 131/339; 131/331; 131/338

(58) Field of Classification Search
CPC .... A24D 3/043; A24D 3/0258; A24D 3/0204
USPC ..... 131/339, 345, 341, 209, 338, 331
See application file for complete search history.

(56) References Cited

U.S. PATENT DOCUMENTS 4,406,294 A 9/1983 Lamb
4,488,563 A 12/1984 Morifuji
4,557,281 A 12/1985 Litzinger, Jr.

(Continued)

FOREIGN PATENT DOCUMENTS

CL 35866 11/1986
EP 0059040 A 9/1982

(Continued)

OTHER PUBLICATIONS

International Search Report and Written Opinion mailed Nov. 6, 2008.

(Continued)

*Primary Examiner* — Richard Crispino
*Assistant Examiner* — Yana B Krinker
(74) *Attorney, Agent, or Firm* — NW Poulsen; LA Pinol

(57) ABSTRACT

A system (100) and method for managing communication session is provided. The system includes a mobile node (104) that is communicably coupled to a first communication network (102). Further, the system includes a first proxy-relay (108). The first proxy-relay is communicably coupled to the first communication network and performs one or more functions on behalf of the mobile node. The system also includes a first policy-profile repository (106) that is communicably coupled to the first communication network. The first policy-profile repository stores a first set of policy-profile definitions describing a first set of services in the first communication network that the mobile node is allowed to access and a first set of rules describing discovery preferences for the mobile mode.

22 Claims, 7 Drawing Sheets

(56) References Cited

U.S. PATENT DOCUMENTS

| | | | | | |
|---|---|---|---|---|---|
| 4,582,071 | A * | 4/1986 | Westcott et al. | ..... | 131/336 |
| 5,076,294 | A * | 12/1991 | Kramer | ..... | 131/331 |
| 5,568,819 | A * | 10/1996 | Gentry et al. | ..... | 131/342 |
| 6,457,475 | B1 * | 10/2002 | Tani et al. | ..... | 131/361 |
| 6,832,613 | B2 | 12/2004 | Brunbauer | | |
| 2005/0000533 | A1 | 1/2005 | Yamada | | |
| 2007/0235046 | A1 * | 10/2007 | Gedevanishvili | ..... | 131/200 |

FOREIGN PATENT DOCUMENTS

| | | | | | |
|---|---|---|---|---|---|
| EP | 0132903 | A | | 2/1985 | |
| EP | 0769253 | | | 4/1997 | |
| EP | 1093728 | | | 4/2001 | |
| EP | 1093728 | A1 | * | 4/2001 | ..... A24D 3/04 |
| EP | 1321050 | A1 | | 6/2003 | |
| GB | 420464 | | | 12/1934 | |
| GB | 864247 | | | 3/1961 | |
| GB | 2088193 | | | 6/1982 | |
| GB | 2090117 | | * | 7/1982 | ..... A24D 3/04 |
| GB | 2090117 | A | | 7/1982 | |
| GB | 2098051 | | * | 11/1982 | ..... A24D 3/04 |
| GB | 2098051 | A | | 11/1982 | |
| GB | 2133269 | | * | 7/1984 | ..... A24D 3/04 |
| GB | 2133269 | A | * | 7/1984 | ..... A24D 3/04 |
| GB | 2133269 | A | | 7/1984 | |
| GB | 2150412 | A | | 7/1985 | |
| GB | 2150413 | | | 7/1985 | |
| GB | 2170694 | A | | 8/1986 | |
| GB | 2170694 | | * | 9/1986 | ..... A24D 3/04 |
| JP | 3858024 | | | 12/2006 | |
| SU | 1382393 | | | 3/1988 | |
| UA | 72029 | | | 1/2005 | |
| WO | 9724934 | A1 | | 7/1997 | |
| WO | 2007093757 | A1 | | 8/2007 | |

OTHER PUBLICATIONS

International Preliminary Report on Patentability, dated Feb. 9, 2010, for International Application PCT/EP2008/059817.

English translation of TIPO's Search Report for Taiwan Patent Application No. 097129157, mailed Jun. 7, 2013.

Office Action dated Jul. 31, 2008 for corresponding Chilean Patent Application No. 2253-08 [with machine translation into English].

Office Action dated Oct. 18, 2011 for corresponding Japanese Patent Application No. 2010-518634.

English translation of Russian Office Action for corresponding Russian Patent Application No. 2010 107 542.

English translation of Russian Office Action dated Oct. 18, 2012 for corresponding Russian Patent Application No. 2010 107 542.

English translation of the 'Decision Concerning a Refusal to Issue a Patent for an Invention' dated May 27, 2013 for corresponding Russian Patent Application No. 2010 107 542.

Examination Report, dated Jun. 27, 2014, for Canadian Application No. 2,694,141.

* cited by examiner

FILTER AND METHOD FOR MAKING A FILTER FOR A CIGARETTE

CLAIM FOR PRIORITY

This application is a National Stage Entry entitled to and hereby claims priority under 35 U.S.C. §§365 and 371 corresponding to PCT Application No. PCT/EP2008/059817, filed Jul. 25, 2008, which in turn claims priority to Application Serial No. GB 0715172.3, filed Aug. 3, 2007, all of which are hereby incorporated by reference.

FIELD OF THE INVENTION

The present invention relates to filters for cigarettes and similar smoking articles.

BACKGROUND

A cigarette typically includes a tobacco rod and a filter connected to the tobacco rod. A smoker ignites one end of the tobacco rod and draws smoke in through the filter.

In a known arrangement, for example UK patent application GB-A-2133269, the filter includes a porous inner material sheet (sometimes referred to as a plug wrap) which wraps the filter rod. The porous inner material sheet is situated between the filter rod and an outer wrapper (sometimes referred to as tipping paper). The inner material sheet is shaped to form a number of grooves which extend from the mouth end of the filter along the axis of the filter and terminate before the tobacco rod end of the filter. When the cigarette is smoked, smoke is drawn from inside the filter rod through the inner material sheet and along the grooves. There is an increased deposition of smoke constituents where the smoke passes through the inner material sheet, due both to the resistance of the sheet material itself, and also to the sudden acceleration of smoke as it enters the grooves.

In many cigarettes, the outer wrapper is wrapped completely around the cigarette and then is glued to itself by a line of adhesion running along the length of the filter. The adhesion process may involve applying pressure along the line of adhesion, which may cause some of the grooves in the inner material sheet underneath the line of adhesion to get crushed and therefore blocked. This may impact the filtration behaviour of the filter and the visual quality of the filter.

SUMMARY OF THE INVENTION

One embodiment of the invention provides a filter for a cigarette or other smoking article, comprising a porous filter rod and an inner porous material sheet wrapped around the filter rod. The inner porous material sheet is shaped to provide a plurality of grooves extending parallel to the rod axis. The grooves have a circumferential distribution around the filter rod such that there are at least two regions of the circumference which are free from the grooves. The cigarette also has an outer material sheet wrapped around the inner porous material sheet.

The groove-free regions are useful in the manufacture of the cigarette. For example, the bonding of the outer material sheet may be aligned with a groove-free region (the outer material sheet may be bonded to itself by providing more than one complete wrap around the filter, or it may be bonded to the inner porous material sheet). This alignment helps to avoid the risk of grooves being crushed or deformed in manufacture, and so makes the filter properties of the cigarette more predictable. The groove-free regions can also be used to help control the draw resistance of the cigarette.

The grooves themselves generally extend partway in a direction parallel to the axis of the filter rod and inwards from a mouth end of the filter. This allows the grooves to provide increased deposition from the smoke, as described above.

In one embodiment, there are two regions free from grooves and the circumferential distribution has a rotational symmetry of order 2. This allows a balanced pressure to be applied from both sides of the cigarette, for example for adhesive bonding of the outer material sheet around the cigarette. In another embodiment, there are three regions free from grooves and the circumferential distribution has a rotational symmetry of order 3. Other embodiments may have different numbers of groove-free regions and different distributions of these regions (not necessarily symmetrical).

Each region free from grooves may subtend an angle at the circumference of for example between 20 and 120 degrees. In one embodiment, each region free from grooves subtends an angle at the circumference of between 35 and 75 degrees. Having a larger groove-free region can help reduce the risk of an adjacent groove being deformed during manufacture (although it also reduces the number of grooves that can be accommodated within the filter). A groove-free region generally subtends an angle that matches the size of multiple grooves, for example three or more such grooves.

In one embodiment, the filter rod comprises cellulose acetate tow and the inner porous material sheet comprises paper (although the skilled person will be aware of other suitable materials). The inner porous material sheet is embossed to provide the grooves. This embossing may also impart the porosity to the inner porous material sheet. Alternatively (or additionally), the porosity of the inner porous material sheet may be due to the intrinsic properties of the sheet material.

In one embodiment, the outer material sheet is porous to allow a ventilating airflow. The ventilating airflow through the outer material sheet may be configured to control a draw resistance of the filter. For example, some of the ventilating airflow may be arranged to enter into the grooves of the filter, while some of the ventilating airflow may be arranged to enter into the filter rod at a region free from grooves.

The filter may comprise one or more segments along the rod axis. If multiple segments are present, they may provide different types of filtration. The grooves (and groove-free regions) may be provided in one or more of multiple segments. In one embodiment, each groove is contained within a single segment (otherwise smoke flowing along a groove would completely bypass that segment). The grooves may extend in different directions in different segments.

Another embodiment of the invention provides a method for making a filter for a cigarette. The method comprises shaping an inner porous material sheet to provide a plurality of grooves and wrapping the inner porous material sheet around a filter rod such that the grooves extend parallel to an axis of the filter rod. The method further comprises wrapping an outer material sheet around the inner porous material sheet. The grooves are distributed circumferentially around the filter rod such that there are at least two regions of the circumference which are free from the grooves.

In one embodiment, the outer material sheet is adhered to itself at an overlap portion that coincides with one of the groove-free regions of the inner material sheet. In another embodiment, at least one of the regions free from grooves provides an adhesion surface for attaching the outer porous material sheet to the inner porous material sheet.

BRIEF DESCRIPTION OF THE DRAWINGS

Embodiments of the present invention will now be described by way of example only with reference to the accompanying drawings where like parts are provided with corresponding reference numerals and in which.

DETAILED DESCRIPTION

Figure 1:
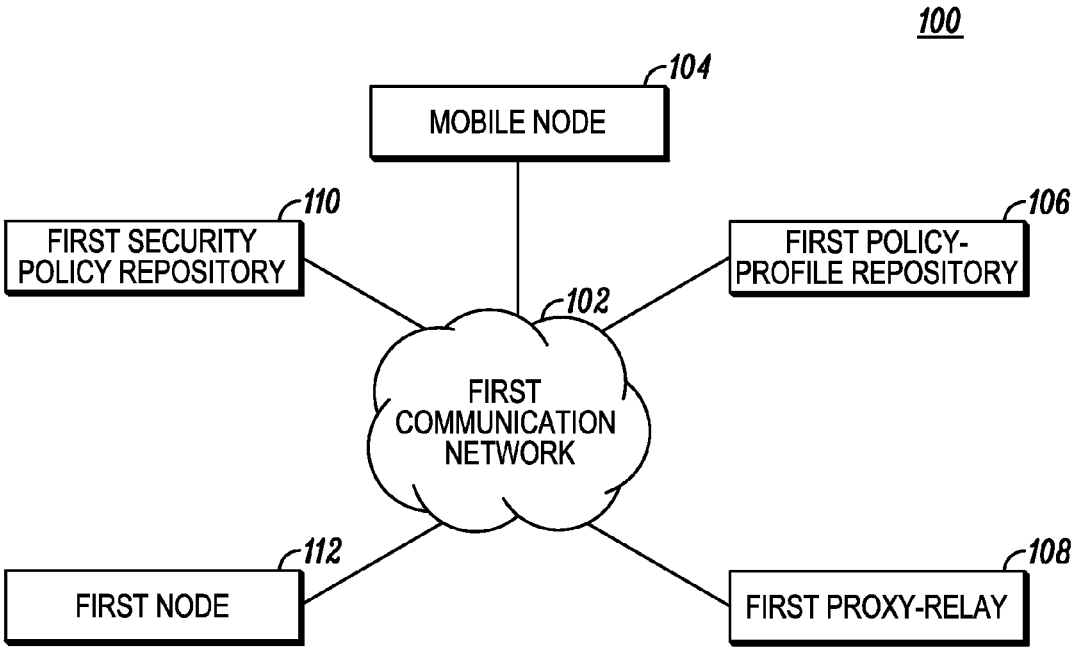
FIG. 1 provides a schematic transverse cross-section through a filter according to one embodiment of the present invention.

FIG. 1 shows a schematic diagram of a filter 1 for a cigarette or other smoking article that accommodates a similar filter in accordance with one embodiment of the present invention. The filter comprises a central rod 2 of filter material such as cellulose acetate (or any other suitable material). The cellulose acetate material may be impregnated or otherwise provided with other filtration materials, such as carbon.

Arranged concentrically outside the filter rod 2 are an inner material sheet 3 (e.g. plug wrap) wrapping the filter rod 2 and an outer material sheet 4 (e.g. outer plug-wrap paper) wrapping the inner material sheet. The embodiment shown in FIG. 1 also includes a further layer 5 (e.g. cigarette/tipping paper) wrapping the outer material sheet 4.

The inner material sheet 3 is embossed or otherwise shaped to define a set of grooves 12A, 12B, etc that run parallel to the main axis of the rod. Each groove defines a small air gap between the outer surface of the inner material sheet 3 and the inside of the outer material sheet 4. In contrast, there is no air gap on the inner surface of the inner material sheet, since the filter material 2 deforms to match the configuration of the grooves. (Note that the radial extent of the grooves is somewhat exaggerated in FIG. 1 for reasons of clarity).

The inner material sheet 3 is porous to allow smoke and air to flow from the filter rod 2 out through the inner material sheet 3 and into the grooves. As previously noted, there is an increased deposition of smoke constituents where the smoke passes through the inner material sheet. This is due in part to the relatively large filtering effect of the sheet material itself, and in part due to the sudden acceleration of the smoke and air as they enter the grooves. In some embodiments, the porosity of the inner material sheet 3 may be the inherent result of the paper-making process. In other cases, the porosity may result from very small tears caused by the embossing of the inner sheet material.

The grooves 12 have a particular circumferential distribution around the filter rod 2. This circumferential distribution includes at least two regions 6, 7 which are free from grooves. Between these two groove-free regions 6, 7 are two corresponding grooved regions. In the embodiment of FIG. 1, the grooved regions are populated with continuous, substantially evenly-spaced and evenly-sized grooves. In other embodiments, there may be more regions free from grooves—e.g. three or four such regions.

The size of a groove-free region in FIG. 1 is denoted by the angle θ, which represents the angle (arc) subtended by the groove-free region 7 at the central axis of the filter rod. The size of the groove-free region, as represented by angle θ, corresponds to multiple grooves, for example perhaps three or more grooves. Likewise, the size of the grooved region corresponds to multiple (continuous) grooves around the circumference. In general, the grooved regions are larger than the groove-free regions.

Figure 2:
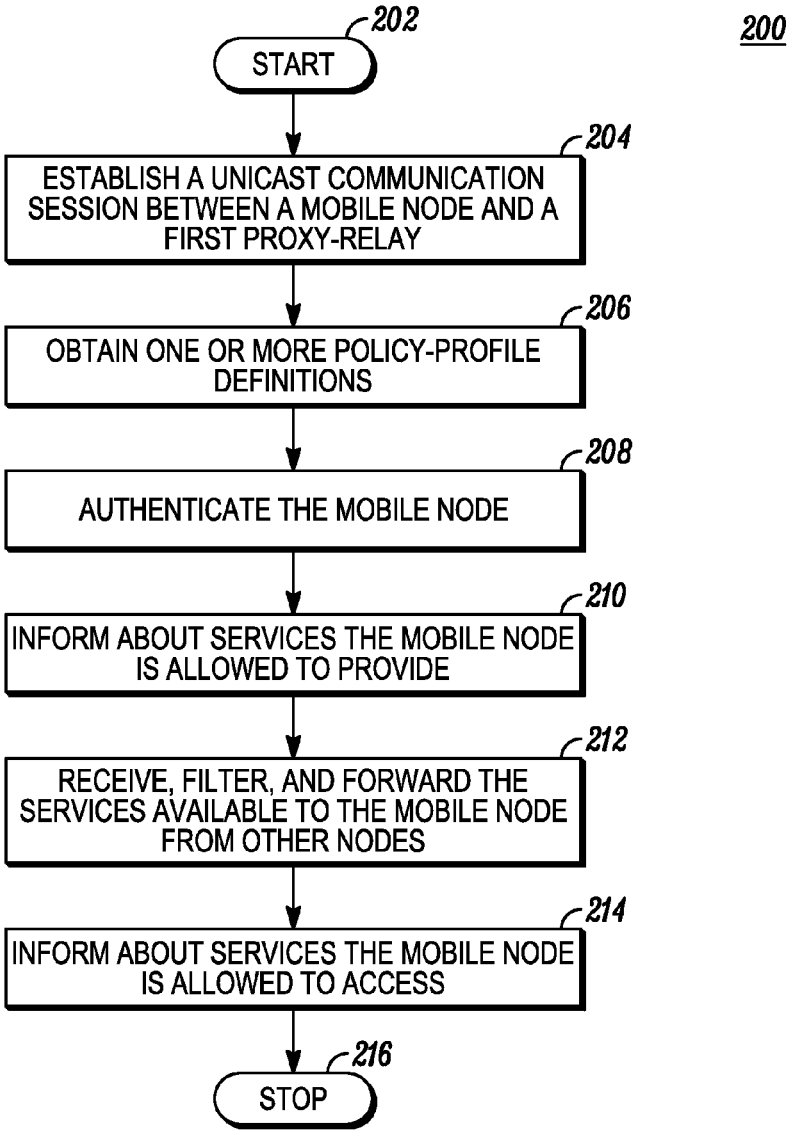
FIG. 2 shows a schematic transverse cross-section through the filter of FIG. 1 as the outer material sheet is being applied to the inner material sheet in accordance with one embodiment of the present invention.

FIG. 2 is a schematic diagram of one stage in the manufacture of the filter 1 of FIG. 1 in accordance with one embodiment of the present invention. In particular, FIG. 2 illustrates the manner in which the outer material sheet 4 is fixed to the filter rod 2, which is assumed to be already wrapped by the inner material sheet 3. In this embodiment, a line of adhesive is applied to the outside surface of the outer material sheet 4 at region 20 of the outer material sheet. Note that this region 20 of the outer material sheet coincides with (lies above) an area free from grooves 6 of the inner material sheet 3.

The outer material sheet 4 is sized such that there is an overlap portion 8 where the outer material sheet extends more once around the circumference of the filter rod. This overlap portion 8 is pressed against surface 20 to allow the adhesive to bond the two surfaces (8 and 20) together. It may also be appropriate during this bonding process to apply a counterbalancing pressure to the opposite side of the outer material sheet 4 from glued portion 20. This opposite side of the outer material sheet 4 is denoted as region 22 in FIG. 2, and also overlies another area free from grooves 7. Once the adhesive bonding has been completed, the outer material sheet 4 holds the inner material sheet 3 and filter material 2 in place. It will be appreciated that further layers, such as an outer cigarette paper wrapping 5, may be applied in the same manner as outer material sheet 4, including the application of pressure, if required, at locations aligned with groove-free regions 6 and/or 7.

If the inner material sheet 3 did not have regions 6 and 7 free from grooves, the grooves underlying surface 20 and/or surface 22 of the outer material sheet might be crushed or deformed by the pressure applied during the adhesion and bonding procedure. In contrast, by providing the groove-free regions 6 and 7 in alignment with surface 20 and surface 22 respectively, this danger is avoided. Thus the areas free from grooves 6, 7 enable the outer material sheet 4 to be applied to the inner material sheet 3 while avoiding (or at least reducing) any crushing or deforming of the grooves. This leads to more consistency in the overall properties of the filter, and also avoids unsightly deformation of the inner material sheet.

As will be understood, there may be other ways in which the outer material sheet 4 and/or the inner material sheet 3 are applied to the filter. For example, there may be no overlap portion 8 in the outer material sheet; rather the outer material sheet may be bonded directly to the inner material sheet (rather than to itself). This bonding between the inner material sheet and the outer material sheet (with adhesive applied to the outer surface of the inner material sheet and/or the inner surface of the outer material sheet) can again coincide with one of the areas free of grooves for the inner material sheet to reduce or avoid damage to the grooves. Note also that in this case, the flat portion of the inner material sheet provides a better surface for adhesion compared to the grooved regions.

In the embodiments of FIGS. 1 and 2, there are two groove-free regions 6 and 7 placed diametrically opposite one another (this corresponds to a rotational symmetry of order 2). This allows pressure to be applied equally to both sides of the cigarette to bond the outer material sheet, as described above. However, other configurations of the groove-free regions may be employed. For example, the groove-free regions might be distributed every 120° (corresponding to a rotational symmetry of order 3). This allows pressure to be applied at three points around the circumference of the filter, which again can be used to bond the outer material sheet without moving the cigarette.

It will be appreciated that other embodiments of a filter may have a different number of groove-free regions and/or a different distribution of the groove-free regions. For example, the groove-free regions around a filter may have different sizes from one another, and/or the locations of the groove-free regions may not be symmetrical or regular.

As shown in FIG. 1, a region free from grooves 7 subtends an angle θ at the centre of the filter rod. As the size of angle θ is increased, this makes it easier to avoid the crushing or distorting of grooves, e.g. during adhesive bonding of the outer wrapper as discussed above. However, increasing the size of angle θ also restricts the number and size of the grooves that can be provided for filtering purposes. Conversely, if a region free from grooves subtends a relatively small angle θ, this may make it more difficult to avoid the crushing or distorting of grooves (since any pressure applied will be closer to the grooves), but it does allow the filter to accommodate more grooves. The angle θ is most generally between 20 and 120 degrees, and in certain embodiments between 35 and 75 degrees—for example about 40 or 50 degrees.

Figure 3:
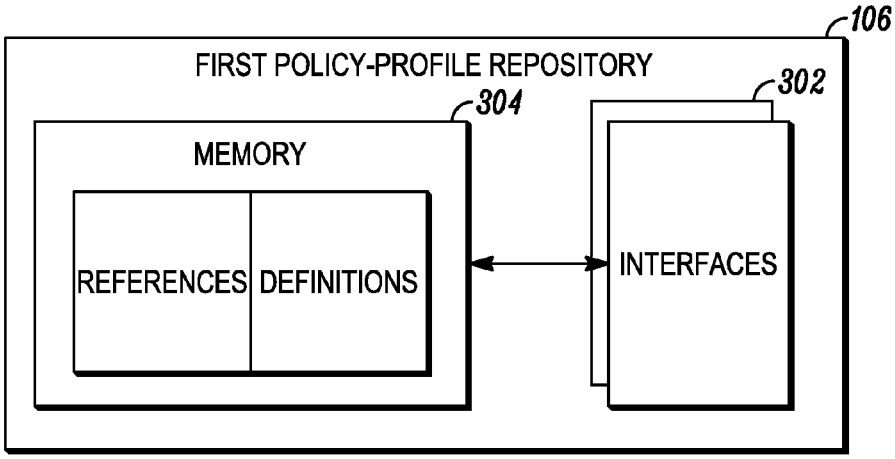
FIG. 3A shows a schematic diagram of a cigarette with ventilating airflow according to one embodiment of the invention.
FIGS. 3B to 3D show three longitudinal cross-sections at different angles through the cigarette of FIG. 3A according to one embodiment of the invention.
Figure 3A:
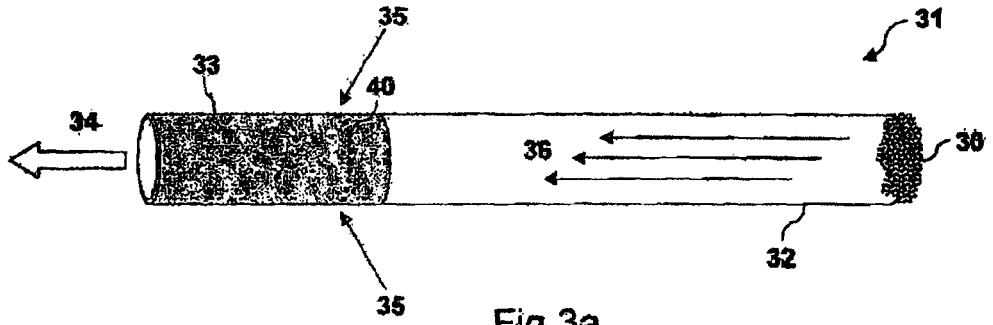

FIG. 3A shows a cigarette 31 comprising a tobacco rod 32 and a filter 33. Smoke 36 from a combustion region 30 is drawn through the tobacco rod and into the filter 33. The outer wrapper of filter 33 is porous to allow ventilating air 35 from outside the cigarette to pass into the filter cigarette. This porosity may be provided by one or more sets of holes 40 in the outer wrapper (as shown in FIG. 3A) and/or by the intrinsic properties of the outer wrapper itself. The ventilating air 35 entering through the outer wrapper dilutes the smoke 34 exiting the mouth end of the cigarette. The amount of ventilating airflow 35 also affects the draw resistance of the cigarette, in that increasing the ventilating airflow tends to reduce the draw resistance. The draw resistance is an important consumer attribute of a cigarette.

Figure 3B:
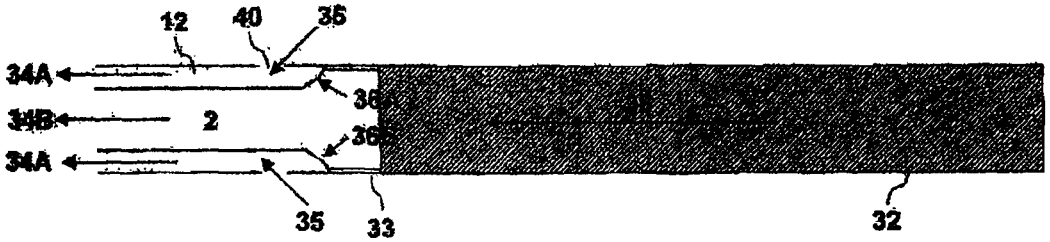

As shown in FIG. 3B, the filter 33 includes a central rod 2 of filter material such as cellulose acetate tow. The filter 33 is also provided with grooves 12, as discussed above, located between the inner wrapper and the outer wrapper. Some of the smoke 36 from the tobacco rod 32 passes through the central filter material before exiting the cigarette at the mouth end, as shown by arrow 34B, while the remaining smoke passes through the inner wrapper and into grooves 12, as indicated by arrows 36A and 36B. This smoke then travels along the grooves before exiting the cigarette at the mouth end, as indicated by arrows 34A.

Figure 3C:
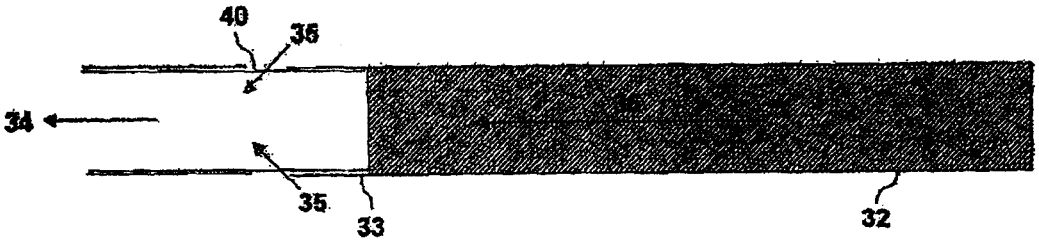
Figure 3D:
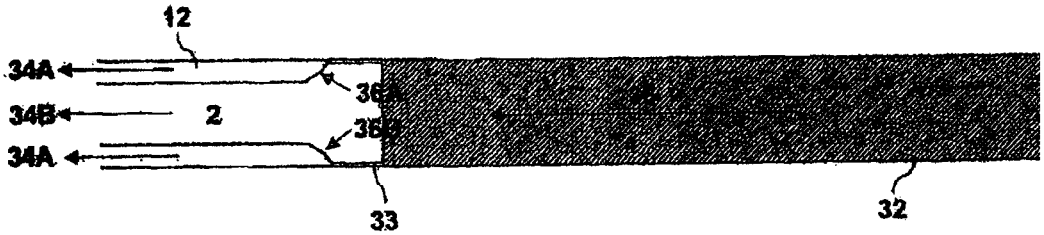
Figure 4:
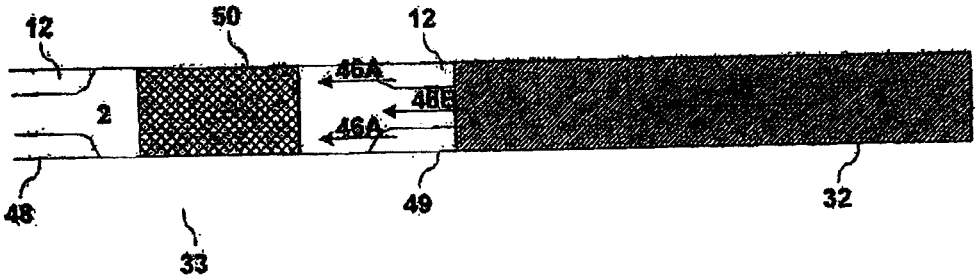

FIGS. 3B, 3C and 3D illustrate three different configurations for the relative positioning of ventilation holes 40 and grooves 12. In FIG. 3B, as described above, a ventilating hole 40 is aligned with a groove 12. Therefore, ventilating airflow 35 passes through the ventilating hole 40 into the groove 12 and then travels directly down the groove 12 before exiting at the mouth end of the cigarette. FIG. 3C illustrates the situation where a ventilating hole 40 is aligned instead with a groove-free region. In this case, the ventilating airflow 35 passes through the ventilating hole 40 and through the inner material sheet into the main body of the filter rod 2. The passage through the inner material sheet may rely on the intrinsic porosity of the inner material sheet, or the inner material sheet may be provided with holes or perforations aligned with holes 40 in the outer material sheet. The ventilating air 35 then mixes with the main smoke flow through the central filter rod. FIG. 3D illustrates the situation where there is a groove 12 but no ventilating hole. In this case smoke travels from the filter rod 2 into the groove 12, as indicated by arrows 36A and 36B. However, there is no ventilating airflow 35 into the grooves 12.

If the ventilation holes 40 are positioned so as to open directly into a groove 12, as shown in FIG. 3B, the draw resistance is comparatively low. However, if the ventilation holes are positioned to avoid the grooved portions (i.e. to coincide with the groove-free regions of the inner sheet material), as shown in FIG. 3C, then the draw resistance is comparatively high. Intermediate values for the draw resistance can be obtained by aligning some of the ventilation holes with the grooves, and some of the ventilation holes with the groove-free regions. Accordingly, the positioning of the ventilation holes vis-a-vis the groove-free regions provides another parameter, along with the total number and size of the ventilating holes, that can be used to help control the draw resistance. It will be appreciated that this flexibility and control does not exist where there are no groove-free regions (since then all the ventilation holes are aligned with grooves). Furthermore, if there are no groove-free regions, so that some of the grooves are liable to be crushed or deformed during manufacture, this in itself makes it more difficult to achieve good control of the draw resistance of a cigarette (irrespective of whether the cigarette is designed to have any ventilating airflow).

Figure 4:
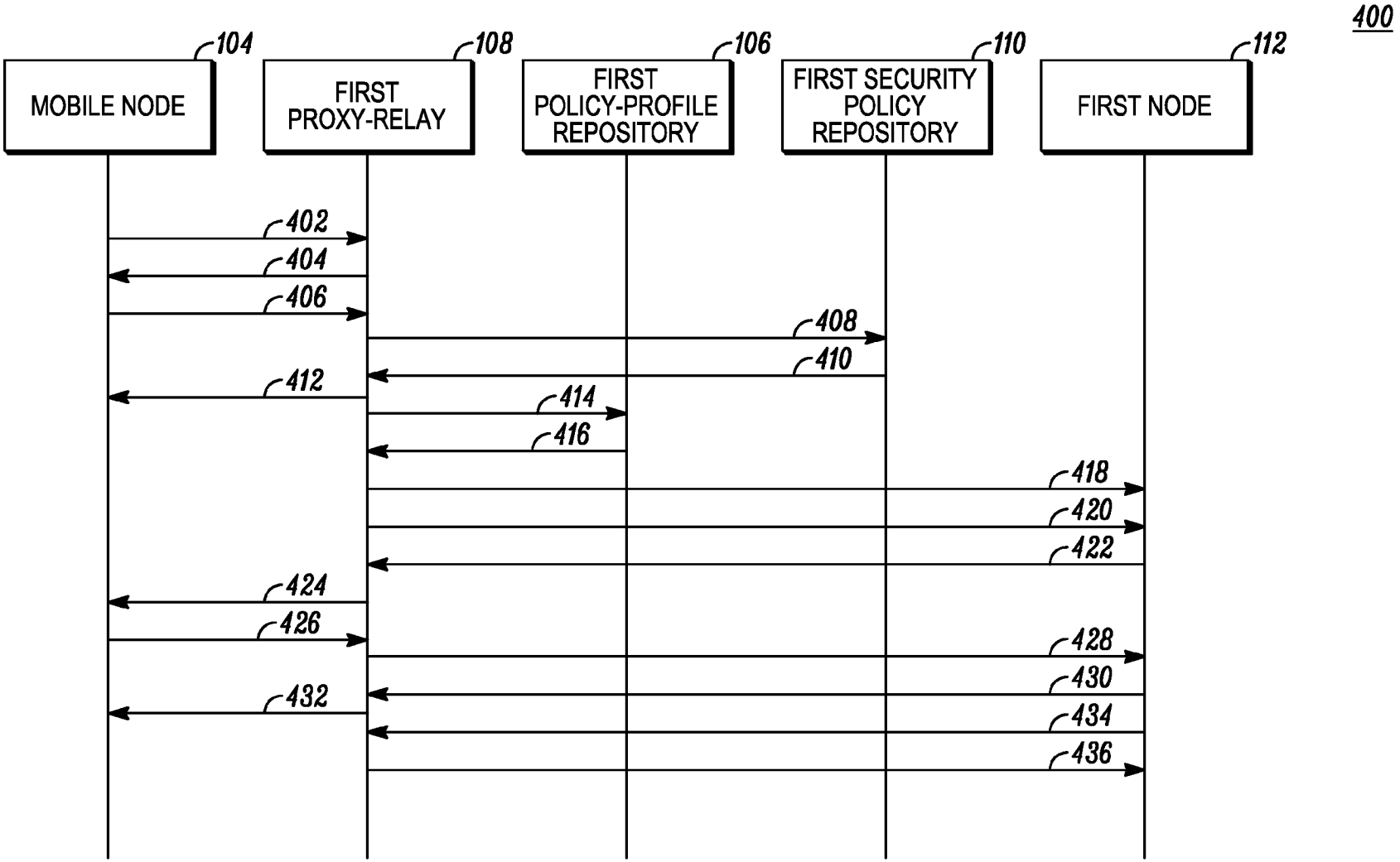
FIG. 4 illustrates a multi-segment filter according to one embodiment of the invention.
Figure 5:
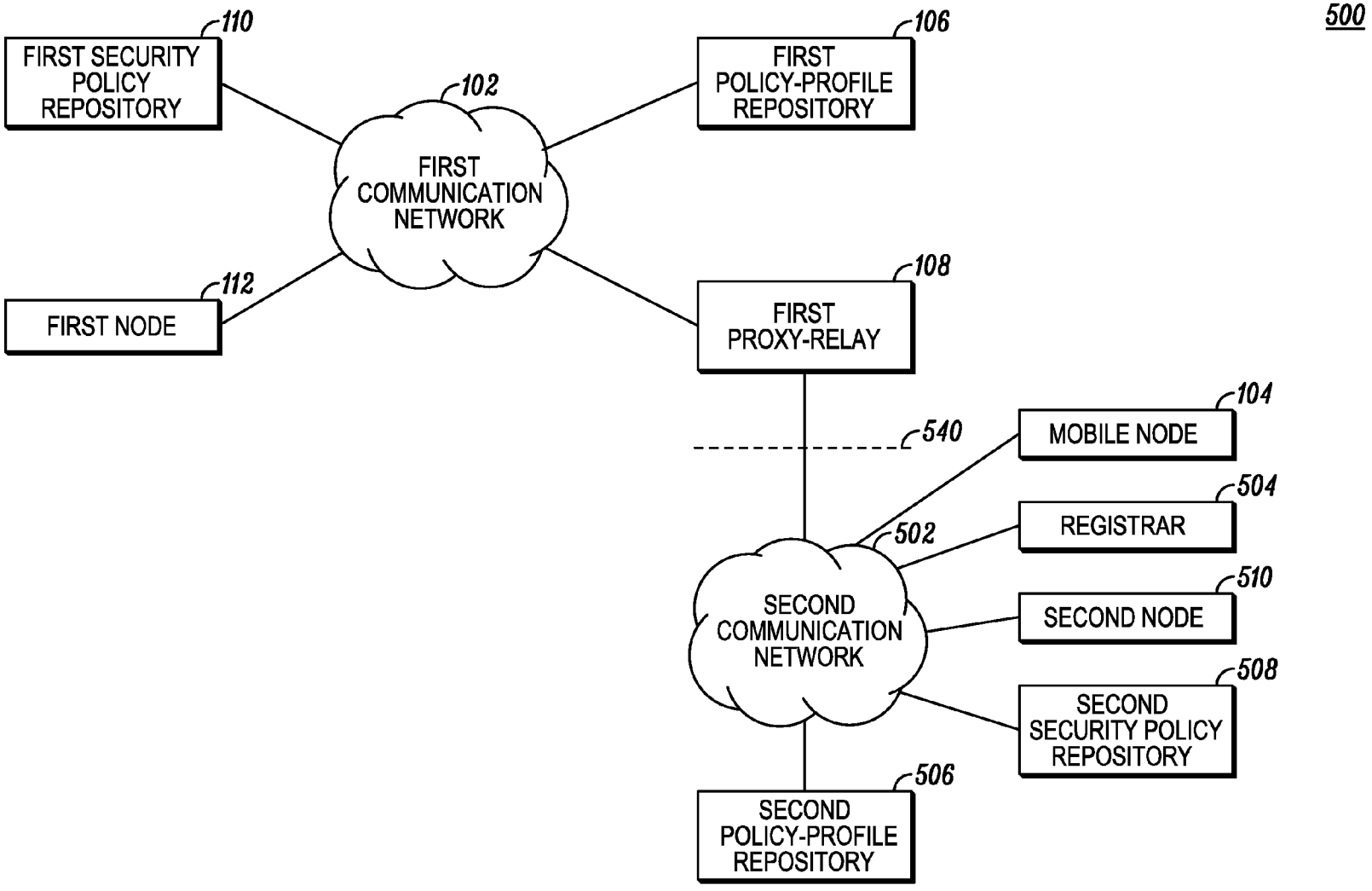
Figure 6:
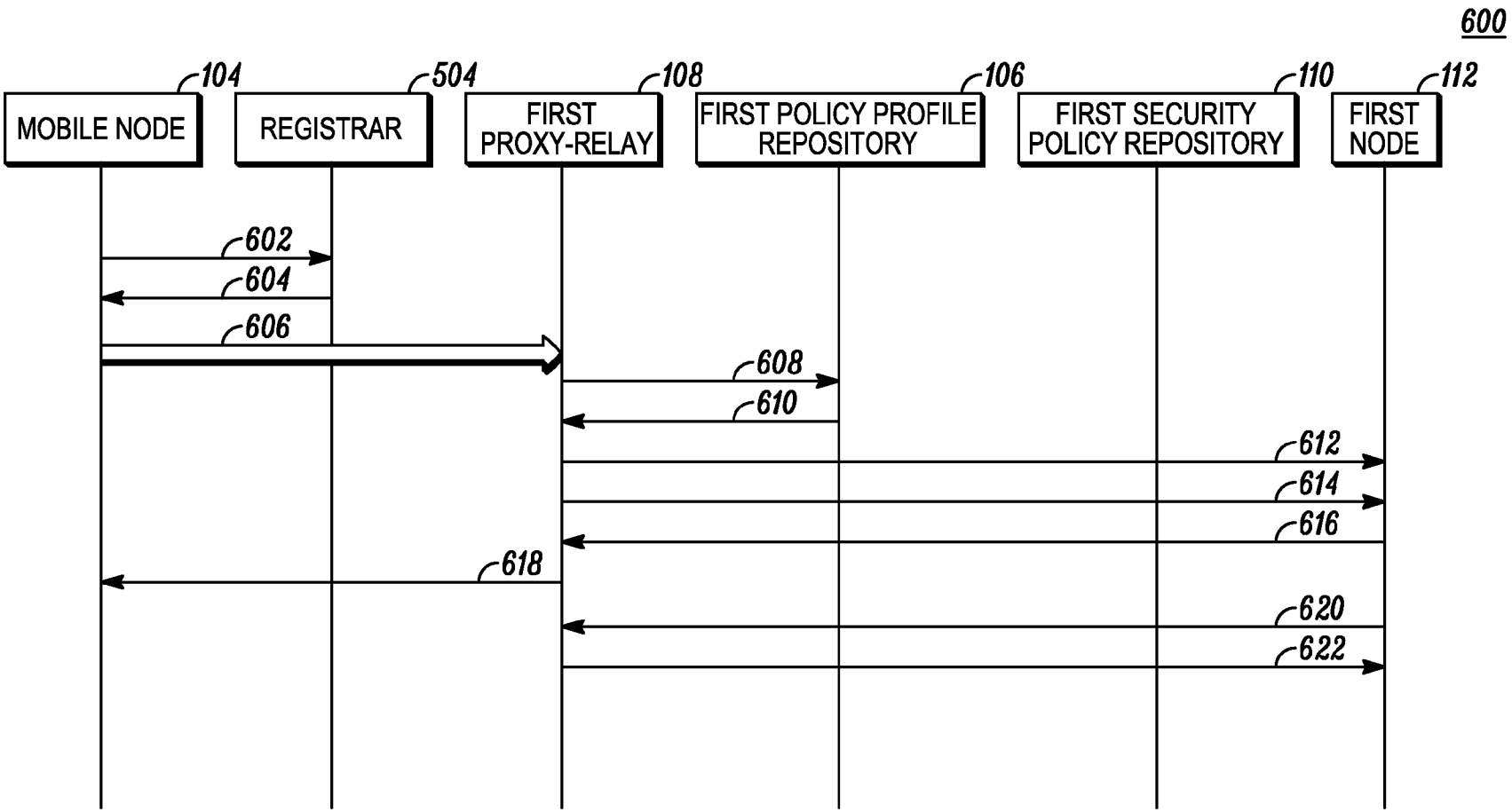
Figure 7:
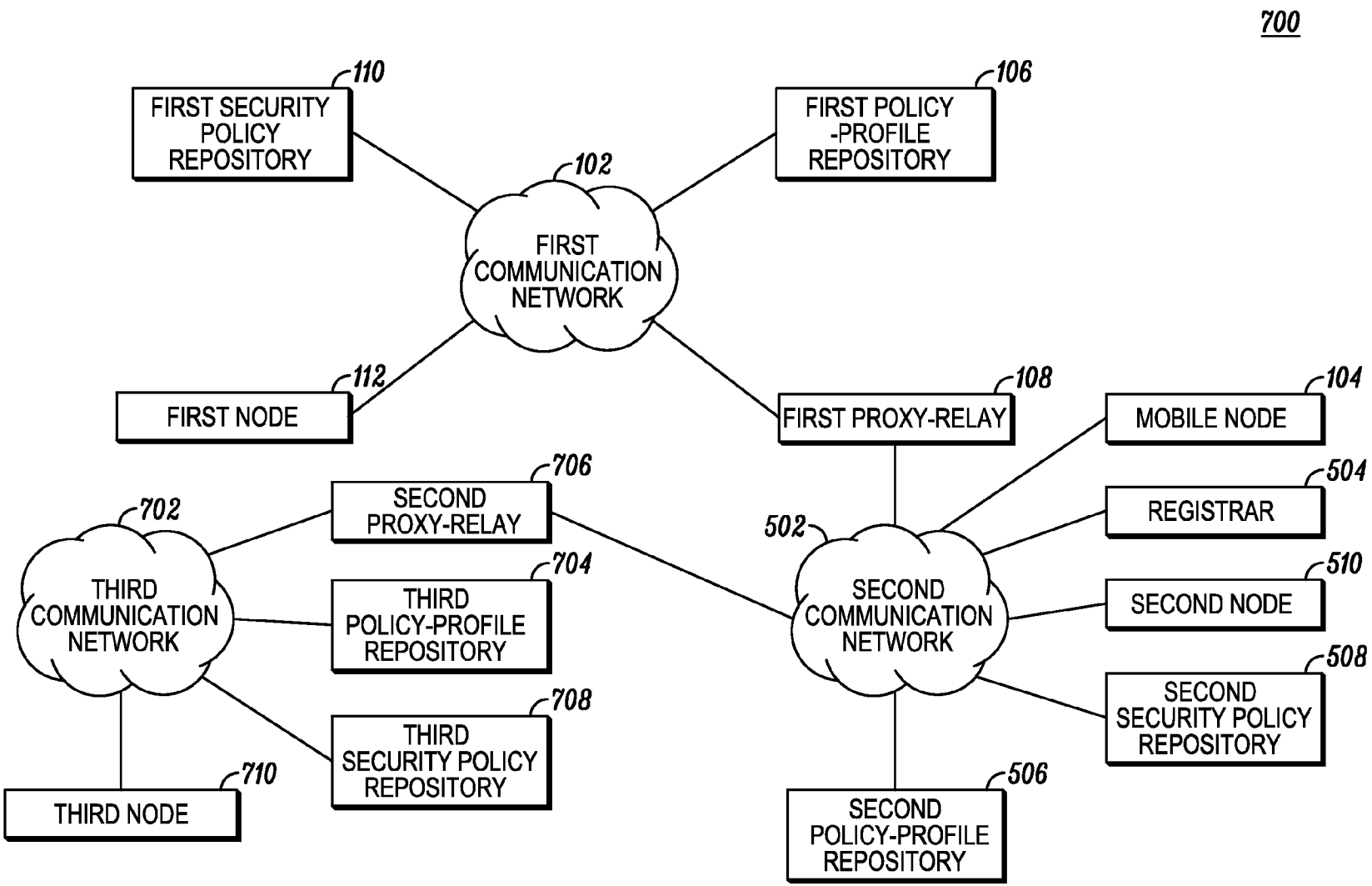
Figure 8:
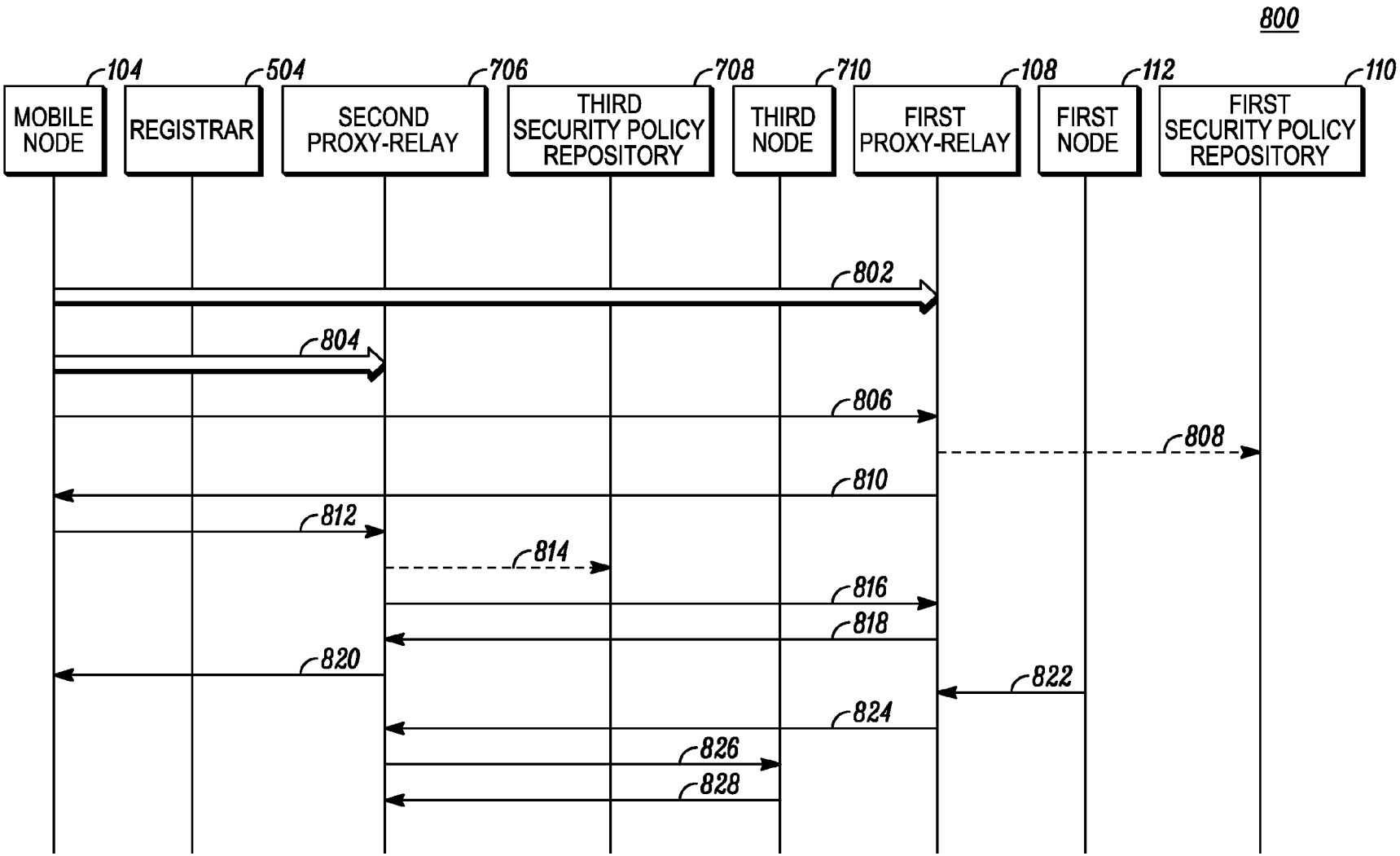
Figure 1:
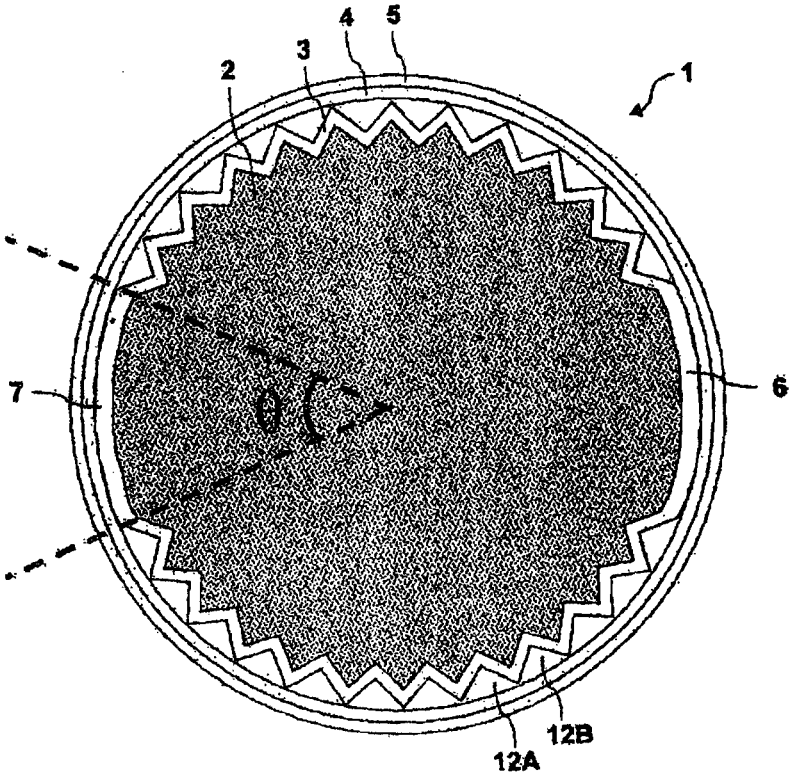
Figure 2:
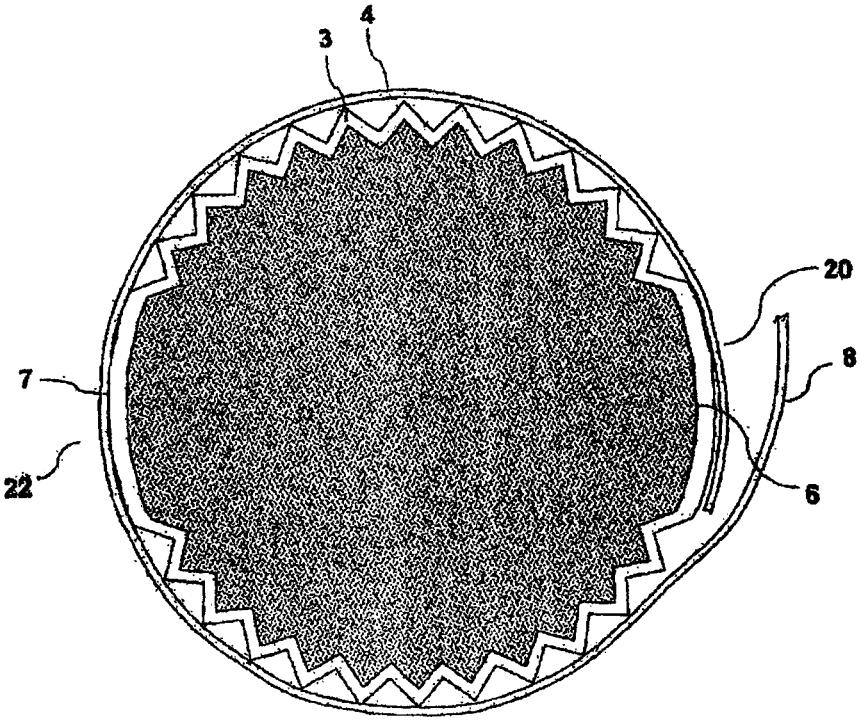

FIG. 4 illustrates a more complex filter 33, which comprises three segments 48, 50, and 49. The first filter section is grooved. The second section 50 comprises a different filter material, for example charcoal or such-like. The third section 49 is analogous to the first filter section 48, but with the grooves extending in the opposite direction (from the tobacco end partway towards the mouth end). Thus some smoke 46 from the tobacco rod 32 passes through the central portion of filter 49, as indicated by arrow 46B, while other smoke passes through the grooves 12 of filter section 49 before passing into the main filter material, as indicated by arrows 46A. The smoke then passes through central section 50, and then through final section 48 (which operates as described above in relation to FIG. 3).

Filter section 48 and/or filter section 49 are provided with a circumferential distribution of grooves that includes at least two groove-free sections, as described above in relation to the filters shown in FIGS. 1-3. In addition, the filter 33 of FIG. 4 may be provided with ventilation holes 40 if so desired.

Note that having filter section 48 as a mirror section of 49 generally aids in the manufacturing process. In particular, a filter rod having a groove running along the central portion can be cut in half, with the left-hand portion ending up as section 49 for one cigarette, and the right-hand portion ending up as section 48 in another cigarette.

Although the various filters so far described have been manufactured using embossed paper for the inner wrap to provide the desired grooves, the skilled person will appreciate that other methods may be used instead. For example, one possibility is to wrap a flat inner plug-wrap around the filter material. The filter rod is then passed through a former or die which is cut or moulded to have the desired groove shape (including the groove-free regions). The filter rod is heated as it passes through former/die (for example, by heating the former/die itself), thereby resulting in the filter retaining the grooved shape of the former/die.

Various other modifications may be made to the embodiments described above without departing from the scope of the invention. For example, in some embodiments of the invention, the grooves may extend along the whole length of the filter, or along the central portion of the filter, or have any suitable configuration. The skilled person will be aware of many further possible variations and modifications. Accordingly, the scope of the present invention is defined by the appended claims and their equivalents.

The invention claimed is:

1. A filter for a cigarette or other smoking article, comprising:

a porous filter rod;

an inner porous material sheet wrapped around the filter rod, the filter rod and the inner porous material sheet being shaped to provide a plurality of continuously grooved regions each containing a plurality of grooves extending parallel to an axis of the filter rod, the grooves having a circumferential distribution around the filter rod such that there are at least two groove-free regions of a circumference of the filter rod which are free from the grooves, each of the plurality of continuously grooved regions subtending an angle of the circumference of the filter rod greater than an angle of the circumference of the filter rod subtended by any one of the at least two groove-free regions, wherein each of the plurality of continuously grooved regions does not include a groove-free region; and an outer material sheet wrapped around the inner porous material sheet.

2. The filter according to claim 1, wherein there are two groove-free regions and the circumferential distribution has a rotational symmetry of order 2.

3. The filter according to claim 1, wherein there are three groove-free regions and the circumferential distribution has a rotational symmetry of order 3.

4. The filter according to claim 1, wherein each groove-free regions subtends an angle at the circumference of between 20 and 120 degrees.

5. The filter according to claim 1, wherein each groove-free regions subtends an angle at the circumference of between 25 and 75 degrees.

6. The filter according to claim 1, wherein the filter rod comprises cellulose acetate tow.

7. The filter according to claim 1, wherein the inner porous material sheet comprises paper.

8. The filter according to claim 7, wherein the inner porous material sheet is embossed to provide the grooves.

9. The filter according to claim 8, wherein the embossing of the inner porous material sheet imparts a porosity to the inner porous material sheet.

10. The filter according to claim 1, wherein the outer material sheet is porous to allow a ventilating airflow.

11. The filter according to claim 10, wherein a porosity of the outer material sheet is configured to control a draw resistance of the filter.

12. The filter according to claim 11, wherein some of the ventilating airflow enters into the grooves and some of the ventilating airflow enters into the groove-free regions.

13. The filter according to claim 1, wherein adhesive bonding of the outer material sheet to the filter is aligned with at least one of the groove-free regions.

14. The filter according to claim 1, wherein the grooves extend partway in a direction parallel to the axis of the filter rod.

15. The filter according to claim 1, wherein the filter comprises multiple segments along the rod axis and wherein each individual groove is contained within a corresponding segment.

16. The filter according to claim 1, wherein at least some of the grooves extend from a mouth end of the filter towards a tobacco rod end of the filter.

17. The filter according to claim 1, wherein at least some of the grooves extend from a tobacco rod end of the filter towards a mouth end of the filter.

18. The filter according to claim 1, wherein each of the plurality of continuously grooved regions is populated with substantially evenly-spaced and evenly sized grooves.

19. A cigarette comprising:

a tobacco rod and a filter, wherein the filter comprises a porous filter rod and an inner porous material sheet wrapped around the filter rod, said filter rod and inner porous material sheet being shaped to provide a plurality of continuously grooved regions each containing a plurality of grooves extending parallel to an axis of the filter rod, the grooves having a circumferential distribution around the filter rod such that there are at least two groove-free regions of a circumference of the filter rod which are free from the grooves, each of the plurality of continuously grooved regions subtends an angle of the circumference of the filter rod greater than an angle of the circumference of the filter rod subtended by any one of the at least two groove-free regions, wherein each of the plurality of continuously grooved regions does not include a groove-free region; and an outer material sheet wrapped around the inner porous material sheet.

20. A method for making a filter for a cigarette or other smoking article, comprising:

shaping a filter rod and an inner porous material sheet to provide a plurality of continuously grooved regions each containing a plurality of grooves;

wrapping the inner porous material sheet around said filter rod such that the grooves extend parallel to an axis of the filter rod; and wrapping an outer material sheet around the inner porous material sheet, wherein the grooves are distributed circumferentially around the filter rod such that there are at least two groove-free regions of a circumference of the filter rod which are free from the grooves, each of the plurality of continuously grooved regions subtends an angle of the circumference of the filter rod greater than an angle of the circumference of the filter rod subtended by any one of the at least two groove-free regions, wherein each of the plurality of continuously grooved regions does not include a groove-free region.

21. The method according to claim 20, wherein the outer material sheet is adhered to itself at an overlap portion that coincides with one of the groove-free regions of the inner material sheet.

22. The method according to claim 20, wherein at least one of the groove-free regions provides an adhesion surface for attaching the outer porous material sheet to the inner porous material sheet.

* * * * *

UNITED STATES PATENT AND TRADEMARK OFFICE

CERTIFICATE OF CORRECTION

PATENT NO. : 8,955,524 B2
APPLICATION NO. : 12/671200
DATED : February 17, 2015
INVENTOR(S) : Peter Rex White It is certified that error appears in the above-identified patent and that said Letters Patent is hereby corrected as shown below:

Delete title page with illustrative figure, and replace with new title page with illustrative figure. (attached)

Title page (57) Abstract please replace with the following:

-- A filter (1) for a cigarette comprises a porous filter rod (2) and an inner porous material sheet (3) wrapped around the filter rod. The inner porous material sheet is shaped to provide a plurality of grooves extending parallel to the rod axis. The grooves have a circumferential distribution around the filter rod such that there are at least two regions of the circumference which are free from the grooves. The filter also comprises an outer material sheet (4) wrapped around the inner porous material sheet. --

In the Drawings

Delete drawing sheets 1-8, and replace with new drawings sheets 1-4. (attached)

Signed and Sealed this
Eleventh Day of August, 2015

Michelle K. Lee

Michelle K. Lee
*Director of the United States Patent and Trademark Office*

(12) United States Patent
White

(10) Patent No.: US 8,955,524 B2
(45) Date of Patent: Feb. 17, 2015

(54) FILTER AND METHOD FOR MAKING A FILTER FOR A CIGARETTE

(75) Inventor: Peter Rex White, London (GB)

(73) Assignee: British American Tobacco (Investments) Limited, London (GB)

( * ) Notice: Subject to any disclaimer, the term of this patent is extended or adjusted under 35 U.S.C. 154(b) by 892 days.

(21) Appl. No.: 12/671,200

(22) PCT Filed: Jul. 25, 2008

(86) PCT No.: PCT/EP2008/059817
§ 371 (c)(1),
(2), (4) Date: Jun. 25, 2010

(87) PCT Pub. No.: WO2009/019154
PCT Pub. Date. Feb. 12, 2009

(65) Prior Publication Data
US 2010/0263682 A1 Oct. 21, 2010

(30) Foreign Application Priority Data
Aug. 3, 2007 (GB) ..... 0715172.3

(51) Int. Cl.
*A24D 3/04* (2006.01)

(52) U.S. Cl.
CPC ..... *A24D 3/043* (2013.01)
USPC ..... 131/339; 131/331; 131/338

(58) Field of Classification Search
CPC .... A24D 3/043; A24D 3/0258; A24D 3/0204
USPC ..... 131/339, 345, 341, 209, 338, 331
See application file for complete search history.

(56) References Cited

U.S. PATENT DOCUMENTS

| | | | |
|---|---|---|---|
| 4,406,294 | A | 9/1983 | Lamb |
| 4,488,563 | A | 12/1984 | Morifuji |
| 4,557,281 | A | 12/1985 | Litzinger, Jr. |

(Continued)

FOREIGN PATENT DOCUMENTS

| | | |
|---|---|---|
| CL | 35866 | 11/1986 |
| EP | 0059040 A | 9/1982 |

(Continued)

OTHER PUBLICATIONS

International Search Report and Written Opinion mailed Nov. 6, 2008

(Continued)

*Primary Examiner* — Richard Crispino
*Assistant Examiner* — Yana B Krinker
(74) *Attorney, Agent, or Firm* — NW Poulsen; LA Pinol

(57) ABSTRACT

A system (100) and method for managing communication session is provided. The system includes a mobile node (104) that is communicably coupled to a first communication network (102). Further, the system includes a first proxy-relay (108). The first proxy-relay is communicably coupled to the first communication network and performs one or more functions on behalf of the mobile node. The system also includes a first policy-profile repository (106) that is communicably coupled to the first communication network. The first policy-profile repository stores a first set of policy-profile definitions describing a first set of services in the first communication network that the mobile node is allowed to access and a first set of rules describing discovery preferences for the mobile mode.

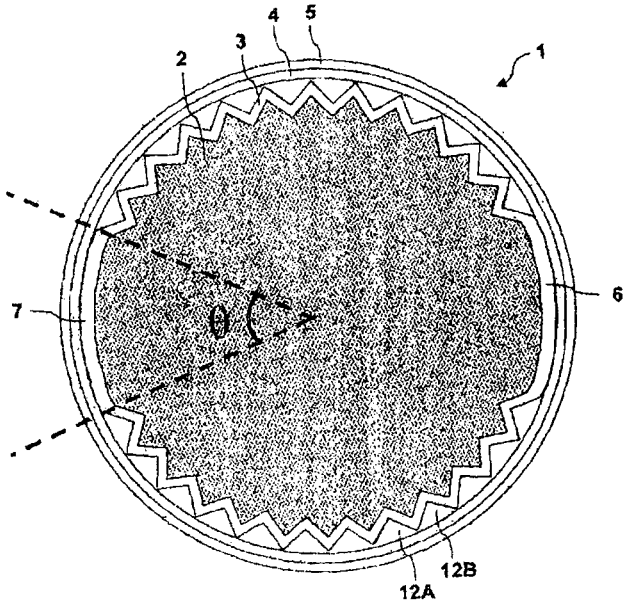

22 Claims, 4 Drawing Sheets